US008823259B2

(12) United States Patent
Moody

(10) Patent No.: US 8,823,259 B2
(45) Date of Patent: Sep. 2, 2014

(54) GRAPHENE SHIELD ENHANCED PHOTOCATHODES AND METHODS FOR MAKING THE SAME

(71) Applicant: Los Alamos National Security, LLC, Los Alamos, NM (US)

(72) Inventor: Nathan Andrew Moody, Los Alamos, NM (US)

(73) Assignee: Los Alamos National Security, LLC., Los Alamos, NM (US)

( * ) Notice: Subject to any disclaimer, the term of this patent is extended or adjusted under 35 U.S.C. 154(b) by 0 days.

(21) Appl. No.: 13/886,517

(22) Filed: May 3, 2013

(65) Prior Publication Data

US 2013/0293100 A1 Nov. 7, 2013

Related U.S. Application Data

(60) Provisional application No. 61/643,802, filed on May 7, 2012.

(51) Int. Cl.
*H01J 40/06* (2006.01)
*H01J 1/34* (2006.01)

(52) U.S. Cl.
CPC ..... *H01J 1/34* (2013.01)
USPC ..... 313/542

(58) Field of Classification Search
CPC ..... H01J 23/04; H01J 1/34; H01J 40/06; C01B 2204/22; C01B 2204/20; C01B 2204/32; G02F 2202/36; H01G 11/32; H05B 33/26; Y10S 977/742
See application file for complete search history.

(56) References Cited

U.S. PATENT DOCUMENTS

| | | | | |
|---|---|---|---|---|
| 4,419,603 | A * | 12/1983 | Nussli et al. | 313/346 R |
| 8,471,444 | B2 * | 6/2013 | Van Spijker | 313/103 CM |
| 2011/0186789 | A1 * | 8/2011 | Samulski et al. | 252/514 |
| 2012/0088039 | A1 * | 4/2012 | Yu et al. | 427/596 |

* cited by examiner

*Primary Examiner* — Donald Raleigh

(57) ABSTRACT

Disclosed are graphene shield enhanced photocathodes, such as high QE photocathodes. In certain embodiments, a monolayer graphene shield membrane ruggedizes a high quantum efficiency photoemission electron source by protecting a photosensitive film of the photocathode, extending operational lifetime and simplifying its integration in practical electron sources. In certain embodiments of the disclosed graphene shield enhanced photocathodes, the graphene serves as a transparent shield that does not inhibit photon or electron transmission but isolates the photosensitive film of the photocathode from reactive gas species, preventing contamination and yielding longer lifetime.

15 Claims, 6 Drawing Sheets

FIGS. 1A-D

GRAPHENE SHIELD ENHANCED PHOTOCATHODES AND METHODS FOR MAKING THE SAME

CLAIM OF PRIORITY

The present application hereby claims priority to U.S. provisional patent application Ser. No. 61/643,802 filed on 7 May 2012 and entitled "Graphene Shield Enhanced Photocathodes and Methods for Making," the entirety of which is incorporated herein by this reference.

STATEMENT REGARDING FEDERAL RIGHTS

This invention was made with government support under Contract No. DE-AC52-06NA25396, awarded by the U.S. Department of Energy to Los Alamos National Security, LLC for the operation of the Los Alamos National Laboratory. The government has certain rights in the invention.

BACKGROUND AND SUMMARY

Use of alkali photosensitive compounds to lower work function has been fundamental to the continued use and development of thermionic dispenser cathodes common to most vacuum electronic devices as well as most practical photocathodes. In the notional thermionic dispenser cathode, an alkali-oxide compound impregnates an electrically and thermally conductive refractory matrix, such as sintered tungsten, which is then heated to greater than 1000° C. The heating process reduces the alkali oxide, freeing alkali atoms to diffuse to an emitting surface (due to concentration gradient) where the alkali atoms lower the work function and enable thermionic emission. These cathodes are relatively rugged and exhibit relatively long lifetimes, on the order of tens to hundreds of kilo-hours, but cannot be rapidly gated for use in high frequency applications that require both a high-quality electron (i.e., high frequency electron injectors and high frequency RF sources). Some efforts have been made to evaluate the possible use of commercial thermionic cathodes as photoemitters: temperature was lowered below that required for thermionic emission (but high enough to release barium) and an incident laser pulse was used to induce photoemission. These efforts resulted in the conclusion that thermionic cathodes cannot serve as photogated emitters in any commercially practical manner. Accordingly, ruggedizing traditional alkali-based photocathodes was attempted through use of compounds such as CsBr. These attempts have been largely unsuccessful because a shield to function as a membrane, the materials attempted must have finite thickness. This thickness has thus far been large enough to disrupt the photoemission process and negate the very effect it is designed to improve.

Accordingly, disclosed herein are embodiments of graphene and graphene composite shield enhanced photocathodes and methods for making the same. The graphene shield enhanced photocathodes provide long-lived photocathodes with high quantum efficiency (QE) at the longest possible wavelength. Although currently there are coatings used to enable semiconductor materials to photoemit with high QE, such materials last only a matter of hours in the vacuum environment of an electron gun. Herein a cathode is disclosed that has the long-life characteristic of metal emitters but the high QE of multi-alkali coatings. Currently available photocathodes emission efficiency degrades over time in a practical vacuum environment because of trace gases, Which contaminate and degrade the sensitive photocathode film. Embodiments of the presently disclosed photocathodes comprise graphene as a robust monolayer shield that protects the photosensitive film from damage, thus extending its lifetime and enabling the photocathode to be air-stable (i.e., capable of being handled after manufacture for limited time periods in air).

Certain disclosed embodiments of the graphene shield enhanced photocathode address a long-felt need for stabilizing a host of highly efficient, but chemically vulnerable, photosensitive films of photocathodes. In many accelerators, the photosensitive films launch photo-gated electron beams, often in extreme environments such as high field, high temperature, hostile and dynamic vacuum of a photoinjector. Photoemission-based electron injectors are widely used because of its current density being significantly higher than that of thermionic emission, providing high beam brightness with unsurpassed control over the spatial and temporal electron beam profile. One of the principle challenges for photoinjection is extending the lifetime of high efficiency photocathode operation. Embodiments of the disclosed graphene shield enhanced cathodes provide relatively stable high QE cathodes.

Embodiments of the graphene shield enhanced photocathodes effectively compensate for their short lifetime by providing a robust shield that is transparent to the incident photons and emitted electrons but isolates the photosensitive films from contaminating gases. Embodiments of the graphene shield enhanced photocathodes can be handled in hostile vacuum environments, perhaps even air, without degradation after manufacture, which vastly simplifies the procedures required for their use and directly translates to lower costs.

In one disclosed embodiment an electron emitting device comprises a photosensitive film and a graphene sheet positioned over the photosensitive film and in direct contact therewith. In another embodiment photocathode comprises a photosensitive film, a graphene sheet having a first surface and a second surface, a graphene support on a first portion of the first surface of the graphene sheet and configured to form a second portion of the first surface of the graphene sheet that is free of the graphene support, and wherein the second portion of the graphene sheet is positioned over the photosensitive film and is in direct contact therewith.

In another embodiment the photocathode substrate has a first surface, the first surface having a first portion and a second portion, a photosensitive film on the first portion of the first surface of the photocathode substrate and a graphene shield membrane directly contacting and completely covering the photosensitive film and connected to the second portion of the first surface of the photocathode substrate, forming a hermetic seal with the graphene shield membrane. The graphene shield membrane may further comprise a graphene support formed on a portion of a first surface of a graphene sheet. In certain embodiments the graphene support comprises a metal foil. The photocathode substrate may comprise molybdenum having an optical quality polish first surface. The graphene support may be configured to form a second portion of the first surface of the graphene sheet that is free of the graphene support.

In certain embodiments of the photocathode the graphene shield membrane comprises a plurality of graphene sheets such as 2 to 100 graphene sheets. In some embodiments the graphene shield membrane is connected to fixed supports in a vacuum environment and the cathode substrate and photosensitive film thereon are mounted to a linear actuator that is movable to place the photosensitive film in direct contact with the graphene shield membrane (while still under vacuum). The graphene shield membrane may be connected to the first surface of the cathode substrate and form a hermetic seal between the first surface of the cathode substrate and the graphene shield membrane.

In another embodiment a photocathode comprises a photosensitive film on a cathode substrate, a graphene shield membrane positioned to form a sealed chamber between the photosensitive film and the graphene shield membrane and capable of shielding the photosensitive film from reactive gas species. The graphene shield membrane may comprise a graphene composite having a graphene sheet with a first and a second surface and a scaffolding formed on the first and/or the second surface of the graphene sheet, the scaffolding capable of supporting the graphene sheet sufficient to form a vacuum sealed chamber between the graphene shield membrane and the photosensitive film.

Various objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1:
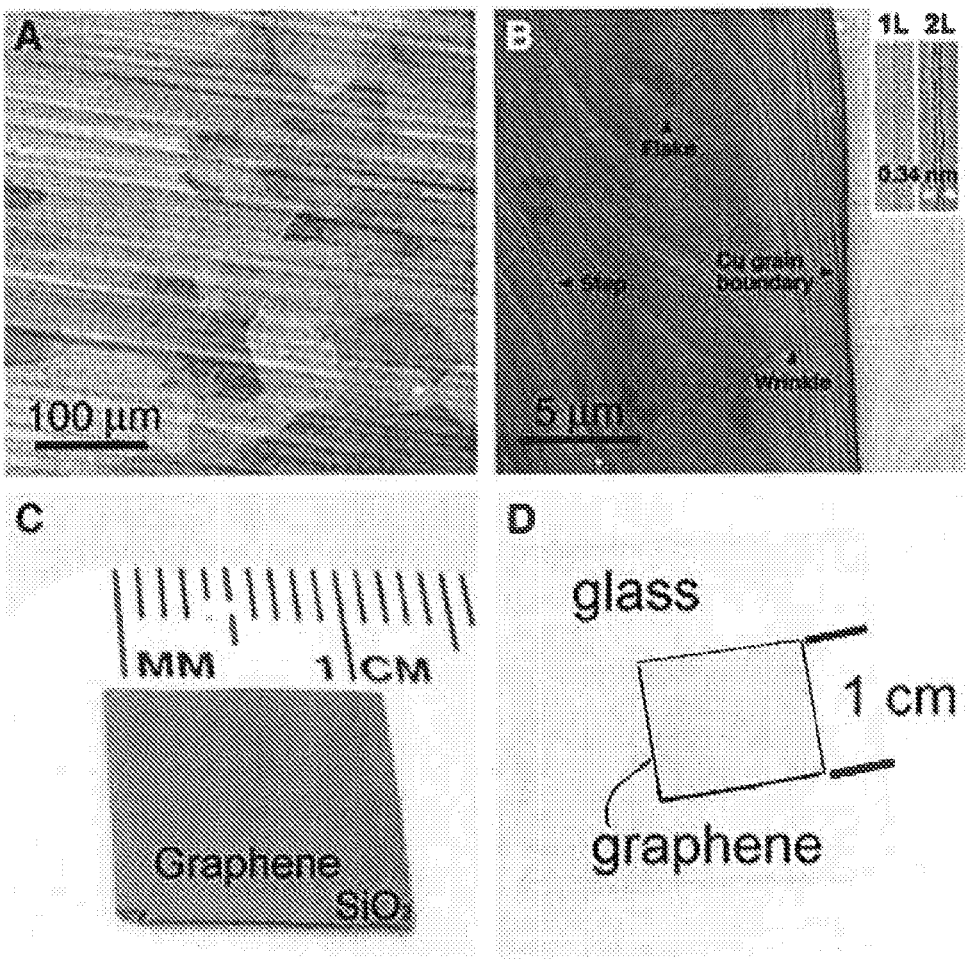
FIG. 1(A) is a SEM image of graphene on copper foil.
FIG. 1(B) is a SEM image showing copper grain boundary, two- and three-layer graphene flakes, and graphene wrinkles; the insert in Figure (B) shows folded graphene edges.
FIGS. 1(C) and 1(D) are photographs of transferred graphene shield membranes.

As a person skilled in the art will recognize from the following detailed description and from the figures and claims, modifications and changes can be made to the preferred embodiments of the invention without departing from the scope of this invention defined in the following claims.

A photocathode is a cathode that emits electrons when exposed to radiant energy and especially light. Photocathodes include photosensitive films that, when struck by a quantum of light (photons), the absorbed energy causes electron emission due to the photoelectric effect. In general, photocathodes are characterized by: the photoemission threshold, which defines the wavelength range of a laser (IR, visible, UV); the quantum efficiency (QE) (the ratio of the emitted electrons over the incident photons), which sets a requirement on the power of a device such as a laser; the lifetime, which defines the working time (as defined either by total integrated emitted charge or total time of productive emission) and the rate of photocathode fabrication, and the working conditions, which define the necessary robustness of the photocathode.

Graphene is generally described as a one-atom-thick planar sheet of sp2-bonded carbon atoms that are densely packed in a honeycomb crystal lattice. Graphene is the basic structural element of some carbon allotropes including graphite, carbon nanotubes and fullerenes. The IUPAC compendium of technology states: "previously, descriptions such as graphite layers, carbon layers, or carbon sheets have been used for the term graphene . . . [i]t is not correct to use for a single layer a term which includes the term graphite, which would imply a three-dimensional structure. The term graphene should be used only when the reactions, structural relations or other properties of individual layers are discussed". It should be understood that the terms "graphene," "graphene layer" and "graphene sheet" as used herein refer only to single layers or sheets. If more than a single graphene sheet or layer is intended, the language will explicitly state "multiple" graphene sheets or layers, or "more than one," or the like particularly denoting that there is more than one, single graphene sheet or layer intended.

As a strictly 2D monolayer honeycomb of carbon atoms, graphene is the thinnest known material and the strongest ever measured. Graphene has many outstanding properties which enable this invention: ultra-high electrical and thermal conductivity, optical transparency, impermeability to all molecular gases, high charge mobility, and ability to sustain extreme current densities.

Disclosed herein are graphene shield enhanced photocathodes, such as high QE photocathodes with enhanced lifetimes. In certain embodiments, a monolayer graphene shield membrane ruggedizes a high quantum efficiency photoemission electron source by protecting a chemically vulnerable photosensitive film of the photocathode. In certain embodiments of the disclosed graphene shield enhanced photocathodes, the graphene serves as a transparent shield that does not inhibit photon or electron transmission but isolates the photosensitive film of the photocathode from reactive gas species, preventing contamination and yielding longer lifetime.

In many accelerators, the photosensitive films launch photo-gated electron beams, often in extreme environments such as high field, high temperature, hostile and dynamic vacuum of a photoinjector. Photoemission-based electron injectors are widely used because current density is significantly higher than that of thermionic emission, providing high beam brightness with unsurpassed control over the spatial and temporal electron beam profile. One of the principle challenges for photoinjection is extending the lifetime of high efficiency photocathode operation. The figure of merit in this regard is the quantum efficiency. Embodiments of the disclosed graphene shield membrane provide chemically-stable, high QE photocathodes that have extended lifetimes.

In one embodiment the photocathode comprises a photosensitive film and a graphene shield membrane positioned on the photosensitive film such that the graphene shield membrane is in direct contact with a surface of the photosensitive film. "In direct contact," as used herein, means that the layers are situated directly upon one another, such that the addition of intervening layers is precluded and it is understood that final assembly in vacuo prevents trapped gases or other contaminants between these layers. In other embodiments the graphene shield membrane is positioned near the photosensitive film with a vacuum area therebetween to protect the photosensitive film from reactive gas species and contamination.

The photosensitive film of the disclosed photocathodes may comprise any suitable photosensitive material. Though certain embodiments discussed herein include $CsK_2Sb$ as the photosensitive film, the photosensitive film may comprise, for example, Sb—Cs, bialkali, high-temperature bialkali or low noise bialkali, multialkali, GaAs, InGaAs, CsI, CsI—Ge, $Cs_3Sb$, $K_3Sb$, $Na_2KSb$, (Cs):$Na_2KSb$, $Cs_2Te$, CsKTe, $Rb_2Te$, RbCsTe, $K_2Te$, alkali bi-metallic alloys such as CsAu, RbAu, polycrystalline diamond or mixtures thereof. The photosensitive film may have a thickness suitable for the application of the photosensitive device in which it is employed, for example, the photosensitive film may have a thickness of from 10 nm to 1000 nm, or 100 nm to 500 nm.

In certain embodiments the photosensitive film includes a cathode substrate. The cathode substrate is formed of any suitable material for the intended application of the photocathode; that is, any suitable material for supporting the photosensitive film (without altering its intrinsic chemistry by virtue of reaction or alloy) and upon which the photosensitive film may be formed, deposited or grown, such as a metal foil or semiconductor support, such as molybdenum, copper, nickel, metal alloys or the like. A cathode substrate is typically used in photocathodes wherein the photons are directed from the front of the cathode toward the photosensitive film though it is envisioned that cathode substrates for the photosensitive film could be dimensioned or configured to support the film without being a complete block to photon transmission.

In certain embodiments of the photocathode the graphene shield membrane comprises or consists of a graphene sheet or layer. In other embodiments the graphene shield membrane comprises or consists of multiple graphene sheets, such as 2-200, 2-100, 2-70, 2-50, 2-20, 2-10 or 2-5 sheets of graphene. In other embodiments the graphene shield membrane comprises or consists of graphene composites, such as a composite of graphene and a scaffolding material, such as polyimide (e.g., KAPTON®). Free standing graphene sheets are not perfectly flat but display intrinsic microscopic roughening and out-of-plane deformations (such as wrinkles or a tendency to curl such as shown in FIG. 1(B)); the graphene scaffolding aids in maintaining the graphene sheet in a flat orientation. In such embodiments the scaffolding may form a netting, woven sheet or similar scaffolding form to be applied to one or both surfaces of the graphene sheet (or graphene sheets) such that the graphene sheet and the scaffolding form a layered composite. The scaffolding material can be any suitable material that allows transmission of the electron beam (e.g., of 10-100 KV) with preferably but not necessarily 95% transmission efficiency, or 85% efficiency or any transmission efficiency level that allows the photosensitive device to operate effectively in the desired application of the device without heating the graphene shield membrane to a temperature that would significantly degrade the graphene shield membrane during operation.

In certain embodiments the graphene shield membrane comprises a single sheet or multiple sheets of graphene and scaffolding and further comprises an organic adhesive to aid in adherence of the scaffolding to the graphene sheet or sheets. In certain embodiments the scaffolding, such as KAPTON®, covers both first and second surfaces of the graphene sheet and extends beyond the edges of the graphene sheet. In such embodiments the adhesive may operate to adhere the edges of the scaffolding that extend beyond the edges of the graphene sheet, to one another to avoid possible interference from pieces of the scaffolding in the cathode device. Further, the adhesive may allow the graphene shield membrane to achieve high tensile strength and elastic modulus sufficient to span a vacuum-gas interface.

The organic adhesive may comprise, for example, poly (methyl methacrylate) (PMMA), or any other suitable adhesive that will not significantly affect the transmission of the electron beam or contaminate the vacuum system. One or both sides of the composite may be covered by an extremely thin copper metallization, increasing conductivity so that it: 1) prevents charge buildup, 2) presents low surface resistance to the gun, and 3) serves as a transparent anode establishing a field within the photocathode.

In other embodiments the graphene shield membrane comprises a single sheet or multiple sheets of graphene with a graphene support attached thereto or coated thereon. The graphene support material may comprise any suitable material capable of supporting a graphene sheet, (optionally) capable of being etched to allow for forming a window of pure graphene through which photons and electron beams can be transmitted, and capable of withstanding operation temperatures of the device, such as capable of withstanding temperatures of less than 250° C., 200° C., 150° C., or 100° C. without significant degradation. For example, the graphene support may comprise a foil, such as a metal foil, such as platinum, nickel, copper or metal alloys.

The graphene support may be deposited on, formed on, or attached to the graphene sheet so as to leave an area of the graphene sheet free of the support such that a small area of the graphene shield membrane (e.g., a circular region centrally located for the sake of design convenience in most photocathodes) comprises only graphene while the remainder of the graphene shield membrane comprises a graphene sheet and the graphene support. In certain embodiments the graphene support may be deposited on, formed on, or attached to an entire surface of the graphene sheet and then a portion of the graphene support is removed, for example by etching, so as to leave an area (referred to herein as a window) of the graphene shield membrane open to transmission of photons and the electron beam yet leave enough of the graphene support to provide the needed support for the graphene shield membrane to operate as intended. The graphene shield membrane window may be circular in shape or any other suitable shape and dimension, and may be centrally located on the graphene shield membrane or otherwise strategically located thereon such that photons may pass through the shield to reach the photosensitive film.

Figure 3:
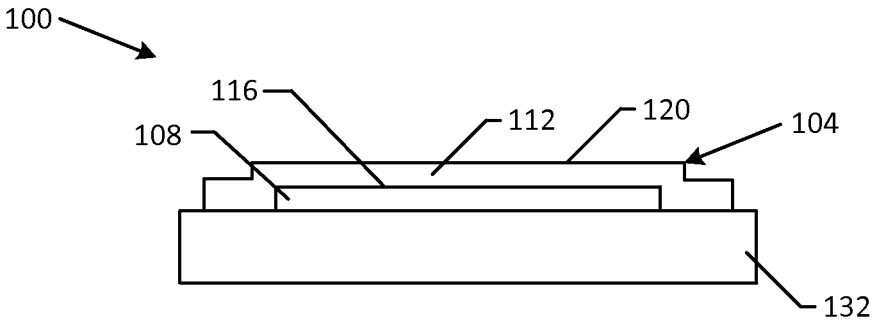
FIG. 3 is a side view of an embodiment of the photocathode.

FIG. 3 illustrates an embodiment of the graphene shield membrane 104 placed on a photosensitive film 108 and cathode substrate 132. The graphene shield membrane 104 is positioned directly over (in direct contact with) the photosensitive film 108. The graphene shield membrane 104 comprises a graphene sheet 112 having a first surface 116 in immediate or direct contact with a surface of the photosensitive film 108 and a second surface 120. In alternative embodiments, the photosensitive film 108 can be deposited directly on the cathode substrate 132, which may save time, energy, and/or other resources in the fabrication of the photocathode 100 for some applications.

Figure 4A:
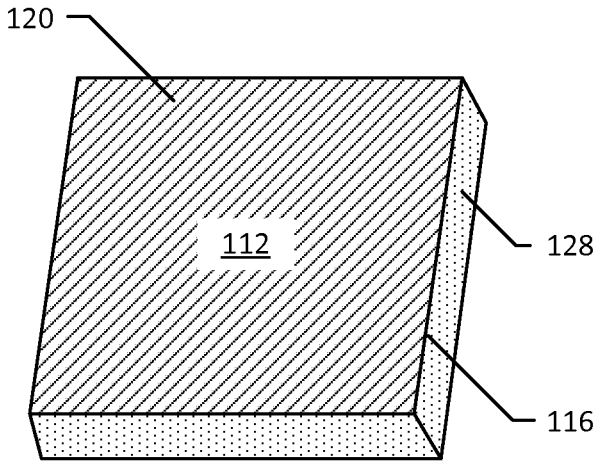
FIG. 4A is an embodiment of the graphene sheet grown on a graphene substrate prior to etching of the graphene substrate.
Figure 4B:
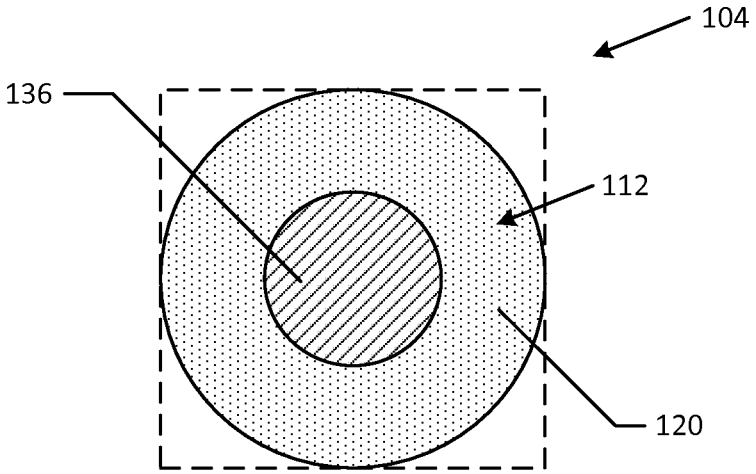
FIG. 4B is an embodiment of the graphene sheet grown on a graphene substrate after etching of the graphene substrate to form a graphene window.

The graphene shield membrane 104, illustrated in FIGS. 4A and 4B, may further comprise a graphene support 128, such as a metal foil. The graphene support 128 may be positioned directly in contact with the first surface 116 or the second surface 120 of the graphene sheet 112, or both surfaces. The graphene support 128 covers only a portion of the first or second surface 116, 120 of the graphene sheet 112 so as to form a graphene window 136 that allows passage of photons and/or the electron beam. The graphene support 128 may surround the photosensitive film 108 (FIG. 5B) while underlying a portion of the graphene sheet 112 such that the support 128 is between the cathode substrate 132 (FIG. 5B) and the graphene sheet 112. Alternatively the graphene support 128 may be on the second surface 120 of the graphene sheet 112 such that the graphene sheet first surface 116 is in immediate and direct contact with the film surface 108 and the cathode substrate.

Figure 5A:
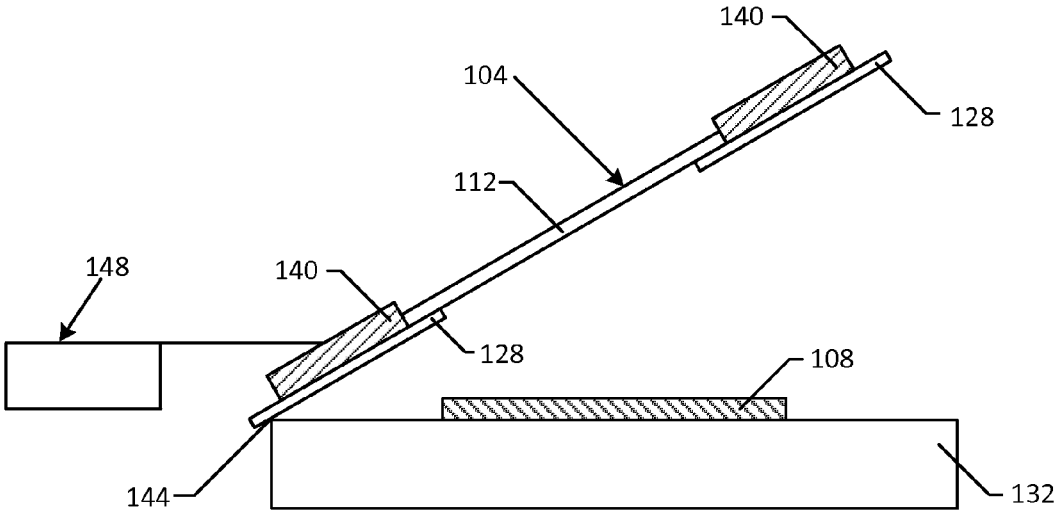
FIG. 5A is a side view of an embodiment of the photocathode wherein the graphene shield membrane is mounted via a hinge.
Figure 5B:
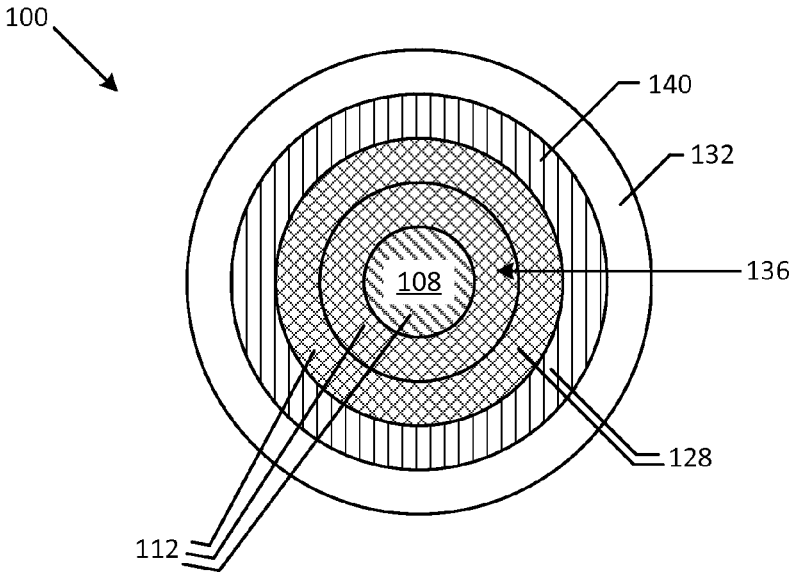
FIG. 5B is a top view of the embodiment of FIG. 5A wherein the graphene shield membrane is mounted onto the photosensitive film.

In one embodiment of the disclosed photocathode 100, FIG. 5A, the graphene shield membrane 104 is connected to the cathode substrate 132 via a hinged connection 144. The graphene shield membrane 104 may be lowered onto the photosensitive film 108 and cathode substrate via a pneumatic actuator 148 (or other similar in-vacuo actuating mechanism) that pushes the graphene shield membrane onto the cathode. FIG. 3 illustrates a side view of such a photocathode when the graphene shield membrane 104 is pressed onto the photosensitive film 108 and cathode substrate 132. The graphene shield membrane 104 may comprise a graphene support 128 with an annular support ring 140. FIG. 5B illustrates a top view of the photocathode of FIG. 5A (or FIG. 3) in a "closed" position where the graphene shield membrane 104 is pressed onto the cathode substrate 132 and the graphene window 136 covers the photosensitive film 108 and is in direct contact therewith.

Figure 6:
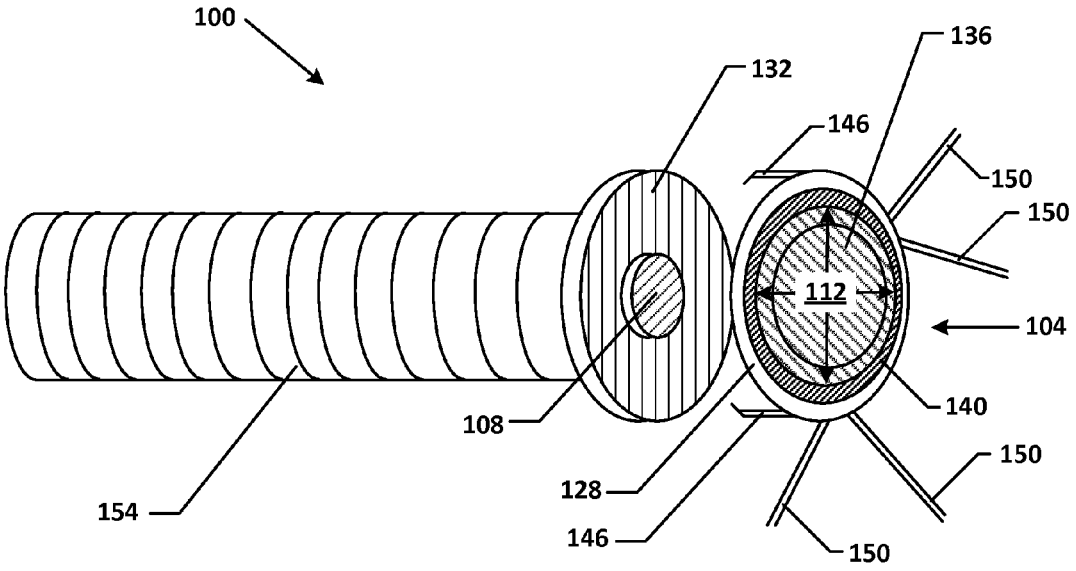
FIG. 6 is a perspective view of an embodiment of the photocathode with a fixed-positioned graphene shield membrane and movable cathode substrate and film.

In another embodiment of the disclosed photocathode 100, FIG. 6, the graphene shield membrane 104 is in a fixed position via stabilizers 150 (in a vacuum). The graphene shield membrane 104 is then connected to the cathode substrate 132 via a linear actuator 154 that pushes the cathode substrate 132 and photosensitive film 108 onto the graphene shield membrane 104 forming a hermetic seal. Fasteners, such as spring clips 146 on the graphene shield membrane 104 hold the graphene window 136 and annular supporting ring 140 rigidly to the cathode substrate 132. The graphene shield membrane 104 covers the photosensitive film 108 and is in direct contact therewith.

Figure 7:
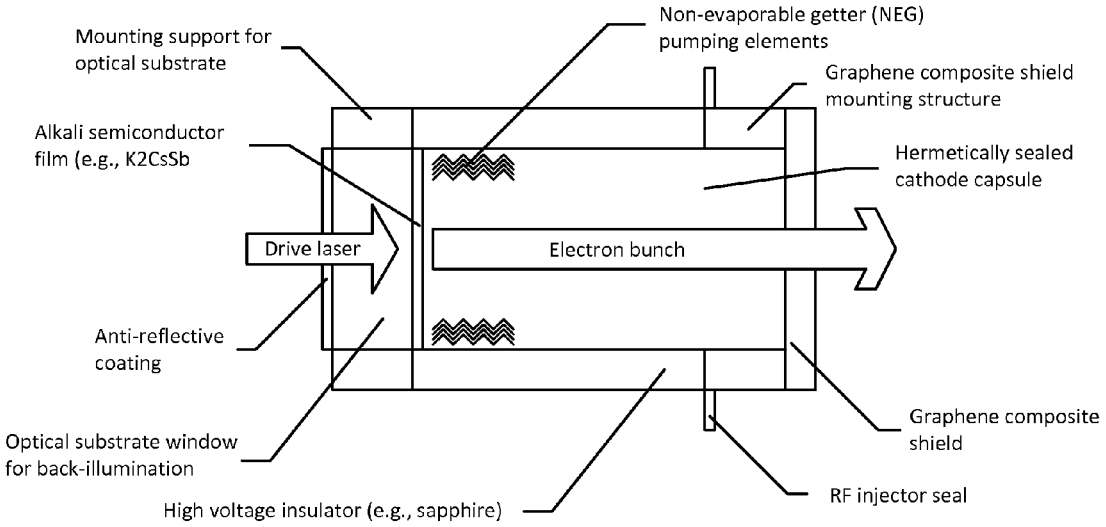
FIG. 7 is a schematic of an embodiment of the photocathode.

In one embodiment, as shown in FIG. 7, the graphene shield membrane 104 is located a distance from the photosensitive film 108 and is positioned to form a sealed chamber, a vacuum chamber between the photosensitive film 108 and the graphene shield membrane 104. The graphene shield membrane 104 thus protects the photosensitive film 108 from reactive gas species, preventing contamination and yielding longer lifetime for the photocathode. In the illustrated configuration the photosensitive film 108 may be changed (depending upon the desired application of the electron emitting device) without changing the graphene shield membrane 104.

The graphene shield membrane 104 illustrated in FIG. 7 is a composite such that the graphene shield membrane has a layer of scaffolding on one or both surfaces of the graphene sheet 112. Alternatively, a graphene shield membrane 104 including a graphene sheet composite may have scaffolding on only one surface of the graphene sheet 112 and be positioned such that the graphene sheet 112 first surface 116 faces the photosensitive film 108 and the second surface 120 is adhered to the scaffolding. The graphene shield membrane 104 may further comprise an adhesive 124 connected to the graphene sheet first and/or second surfaces 116, 120 and/or the scaffolding as discussed above.

The FIG. 7 embodiment may comprise a photocathode 100 wherein the graphene shield membrane 104 composite protects a multi-alkali high QE photosensitive film inside an optional hermetic capsule. In the FIG. 7 embodiment, back illumination of the cathode stimulates high current emission and the capsule geometry is arranged to serve as a high voltage DC diode. As the optically gated electron bunches are launched they accelerate and pass through a composite electron window that is configured to be transparent to energetic electrons with minimal effect on emittance. Accordingly, the photocathode is protected from a damaging vacuum environment of a device such as an RF gun and the high QE photo cathode lifetime is extended for many tens to hundreds of kilo hours. In addition, dark current is reduced, and the device, such as an RF gun, is protected from potential contamination originating from the photocathode surface. Additionally, a DC field at the photocathode may result in higher beam quality, as it eliminates the time dependency of emission due to RF fields.

The notional geometry in the FIG. 7 embodiment includes a gap between a photocathode face and a transparent anode that is large enough that, initially, that a gap voltage can be sufficiently reduced to eliminate risk of breakdown while still high enough to yield electrons with energies corresponding to good graphene transparency. The embodiment of the photocathode illustrated in FIG. 4 enables an electron bunch to enter at any desired RF phase because it has been pre-accelerating, allowing higher bunch compression in the electron injector. In certain embodiments the protective transparent anode window is a low-Z composite material similar in concept to that used to isolate the vacuum and gas volumes of an electron-beam pumped excimer laser.

In the embodiments disclosed above the optical quality polish of the cathode substrate surface is sufficient to form a hermetic seal with the graphene support and overlapping portion of the graphene sheet.

Also disclosed herein are methods for making the disclosed graphene shield enhanced photocathodes. In some embodiments the method comprises (1) growth and preparation of the cathode photosensitive film, (2) growth and preparation of the graphene shield membrane, and (3) integration of the graphene shield membrane's graphene support with a cathode substrate.

Figure 2:
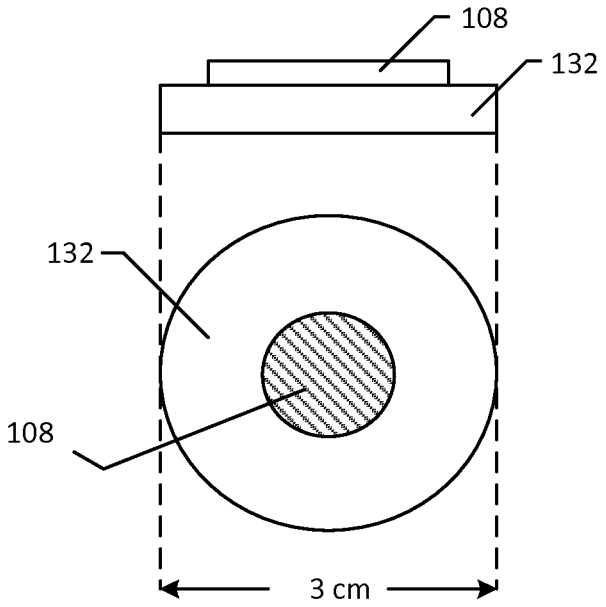
FIG. 2 is a side and top view of a photosensitive film on a cathode substrate.

In one embodiment of the disclosed methods, an optically polished atomically cleaned cathode substrate comprising molybdenum is used for growth of the photosensitive film. The photosensitive film may be formed by any suitable means, such as by CVD film growth of a well-known high QE photosensitive film material, such as $CsK_2Sb$. During the deposition, the photosensitive film area (e.g., 2 $mm^2$) is masked such that the resulting film deposited is smaller than the cathode substrate. As such, the later applied graphene shield membrane can cover the photosensitive film and make intimate contact with the atomically clean cathode substrate (see, e.g. FIG. 2).

Graphene is first grown on a separate support system such as SiC or the graphene sheet support, such as the metallic foil (e.g., Ni or Cu) discussed above so that the useable area approaches several square millimeters, up to a square centimeter, as shown in FIG. 1(A-D) or FIGS. 4A and B, to the size desired for a particular electron emission device to be formed. The foil can be cut into a desired shape, such as a circle to match the OD of the cathode substrate and can be masked such that when etched a window, such as a circular centered window shown in FIG. 4B is formed and the graphene sheet is suspended on the foil support.

Using a commercially available diamond growth chamber (e.g., Kurt J. Lester or equivalent) or a custom-designed vacuum system with similar capabilities, the first step is to grow graphene films on large copper foils. Commercially available Cu foil of 25 μm thickness provides a good balance between mechanical stability for the graphene and the ability to etch the metal in subsequent steps. The reactor chamber is loaded with Cu foil, evacuated to a base pressure, backfilled with $H_2$(g), heated to 1000° C. maintained at 40 mTorr pressure using 2 ccm flow. A 35 ccm flow of $CH_4$(g) is introduced to yield a total chamber pressure of 500 mTorr. The process of graphene growth under these conditions is self-limiting, reaching completion within 10 minutes. The chamber is then cooled at a rate of 10-50° C./min and the graphene films on Cu can be handled in atmosphere.

The graphene surface may then be spin-coated with an organic adhesive (PMMA) and the entire structure submersed in an aqueous solution of iron nitrate to etch the Cu foil away. If foils or scaffold materials other than Cu are chosen, then an appropriate etchant and mask material will be also chosen to accommodate. This leaves a high quality, large-area graphene sheet attached to PMMA. Lastly, Pt is deposited onto the now-exposed face of the graphene sheet, except for an area defined by a small circular mechanical mask. Finally, removal of the PMMA yields a new Pt foil attached to the graphene with a centrally located graphene window that is approximately 5-10 $mm^2$.

The photosensitive film and the graphene shield membrane are then integrated in a vacuum environment. The graphene membrane, supported by a Pt foil, is mounted on a rigid structure within the cathode deposition chamber prior to its evacuation. The cathode chamber, with vacuum characteristics similar to a photoinjector, allows fabrication of the $CsK_2Sb$ (or similar) photosensitive film. The graphene shield membrane (on a mobile support mechanism) is into position such that the cathode substrate can be press-fit against the pre-mounted graphene shield membrane. In this manner, the graphene shield membrane not only covers the photosensitive film, but also overlaps a large area of the atomically cleaned (Ar-ion gun) cathode substrate so that a hermetic seal is formed via van der Waals forces.

As a result of the above disclosed configurations and components, a photocathode as disclosed, based on transmission measurements (both electronic and optical) of nano-structured carbon films (i.e., much thicker than graphene), will have suitable photoemission with vastly improved robustness or ruggedness of the cathode. In addition, embodiments of the disclosed photocathodes operate more safely as the graphene shield membrane inhibits desorption of cathode material.

Designers of nearly every large and small scale photoinjector will benefit from the commercial availability of the disclosed photocathodes. The disclosed long-lived, high QE photocathodes enable smaller, lower power drive lasers to be used at significant cost savings (since the drive laser is one of the most expensive components). Many designers are pushing toward development of "table-top" accelerators for high power sources of THz, IR, Visible, UV, and x-ray light. Embodiments of the photocathodes disclosed herein aid in an enabling technology in these applications. Also, in the field of vacuum electronics, certain of the photocathode embodiments disclosed herein (together with a low power laser diode or LED) can be used to replace the power-hungry thermionic emitters that have been the mainstay in many applications such as x-ray tubes used for medicine and national security. Despite recent advances in commercial x-ray sources, all still use thermionic emitters to create an electron beam. The supply used to power the cathode filament heater has to be held at tens to hundreds of kilovolts potential. This leads to an unavoidably large form factor, in addition to the large power load, which is a limiting factor in further miniaturization of these sources. Replacing a hot thermionic emitter with embodiments of the disclosed room temperature photocathodes having similarly long life and robustness due to the graphene shield membrane can lead to a drastic reduction in the size and cost of x-ray sources and other similar devices requiring electron beam generation.

As used in this application and in the claims, the singular forms "a," "an," and "the" include the plural forms unless the context clearly dictates otherwise. Additionally, the term "includes" means "comprises." Further, the term "coupled" generally means electrically, electromagnetically, and/or physically (e.g., mechanically or chemically) coupled or linked and does not exclude the presence of intermediate elements between the coupled or associated items absent specific contrary language.

Unless otherwise indicated, all numbers expressing quantities of ingredients, properties such as molecular weight, percentages, measurements, ratios, and so forth, as used in the specification or claims are to be understood as being modified by the term "about." Accordingly, unless otherwise indicated, implicitly or explicitly, the numerical parameters set forth are approximations that may depend on the desired properties sought and/or limits of detection under standard test conditions/methods. When directly and explicitly distinguishing embodiments from discussed prior art, the embodiment numbers are not approximates unless the word "about" is recited.

The foregoing description of the preferred embodiments of the invention has been presented for purposes of illustration and description and is not intended to be exhaustive or to limit the claimed invention to the precise form disclosed. Those of skill in the art will readily appreciate that many modifications and variations to the claimed invention are possible in light of the above teaching. The preferred embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined exclusively by the following claims.

What is claimed is:

1. A photocathode comprising:

a photosensitive film;

a graphene sheet having a first surface and a second surface;

a graphene support on a first portion of the first surface of the graphene sheet and configured to form a second portion of the first surface of the graphene sheet that is free of the graphene support; and wherein the second portion of the graphene sheet is positioned over the photosensitive film and is in direct contact therewith.

2. An apparatus comprising:

a photocathode substrate having a first surface, the first surface having a first portion and a second portion;

a photosensitive film on the first portion of the first surface of the photocathode substrate;

a graphene shield membrane comprising a graphene support formed on a portion of a first surface of a graphene sheet and directly contacting and completely covering the photosensitive film and connected to the second portion of the first surface of the photocathode substrate and forming a hermetic seal with the graphene shield membrane and wherein the graphene support is configured to form a second portion of the first surface of the graphene sheet that is free of the graphene.

3. The apparatus of claim 2 wherein the graphene support comprises a metal foil.

4. The apparatus of claim 2 wherein the photocathode substrate comprises chemically inert material having a first surface capable of forming a hermetic seal.

5. The apparatus of claim 2 wherein the graphene shield membrane further comprises 2 to too graphene sheets.

6. An apparatus comprising:

a photocathode substrate having a first surface, the first surface having a first portion and a second portion;

a photosensitive film on the first portion of the first surface of the photocathode substrate;

a graphene shield membrane connected to an annular ring and directly contacting and completely covering the photosensitive film and connected to the second portion of the first surface of the photocathode substrate and forming a hermetic seal with the graphene shield membrane.

7. The apparatus of claim 6 wherein an annular ring is mounted to the metal foil thereby forming a rigid graphene shield membrane.

8. The apparatus of claim 7 to wherein the graphene shield membrane and annular ring are pivotably connected to the cathode substrate.

9. The apparatus of claim 6 wherein the graphene shield membrane is connected to fixed supports in a vacuum environment and the cathode substrate and photosensitive film thereon are mounted to a linear actuator that is movable to place the photosensitive film in direct contact with the graphene shield membrane.

10. The apparatus of claim 9 wherein the graphene shield membrane further is connected to the first surface of the cathode substrate and forming a hermetic seal between the first surface of the cathode substrate and the graphene shield membrane.

11. A photocathode comprising:

a photosensitive film on a cathode substrate;

a graphene shield membrane positioned to form a sealed chamber between the photosensitive film and the graphene shield membrane and capable of shielding the photosensitive film from reactive gas species.

12. The photocathode of claim 11 wherein the graphene shield membrane comprises a graphene composite having a graphene sheet with a first and a second surface and a scaffolding formed on the first and/or the second surface of the graphene sheet, the scaffolding capable of supporting the graphene sheet sufficient to form a vacuum sealed chamber between the graphene shield membrane and the photosensitive film.

13. The photocathode of claim 12 further comprising an adhesive formed on the scaffolding.

14. The photocathode of claim 13 wherein the graphene shield membrane further comprises 2 to 100 graphene sheets.

15. The photocathode of claim 12 wherein the scaffolding comprises a polyimide.

* * * * *